United States Patent [19]

Rosenthal

[11] Patent Number: 4,865,575

[45] Date of Patent: Sep. 12, 1989

[54] LIGHT RESPONSIVE REMOTE CONTROL VEHICLE

[75] Inventor: Doren Rosenthal, San Luis Obispo, Calif.

[73] Assignee: Mattel, Inc., Hawthorne, Calif.

[21] Appl. No.: 267,400

[22] Filed: Nov. 4, 1988

[51] Int. Cl.[4] ..... A63H 30/00

[52] U.S. Cl. ..... 446/175; 446/219; 273/312

[58] Field of Search ..... 446/175, 462, 454, 219; 273/312, 310

[56] References Cited

U.S. PATENT DOCUMENTS 2,922,929 1/1960 Cooper et al. ..... 446/175 X 3,621,356 11/1971 Kwan ..... 446/175 X

FOREIGN PATENT DOCUMENTS 729375 12/1966 Italy ..... 446/175

*Primary Examiner*—Mickey Yu

*Attorney, Agent, or Firm*—Roy A. Ekstrand

[57] ABSTRACT

A light responsive remote control vehicle is operated in response to a beam of colored control light eminating from a hand operated and handheld controller. The vehicle is operative on a track having confining side walls and includes a pair of light sensors which respond solely to the illumination of the vehicle by the colored light beam. Electronic circuitry controls the operation of the vehicle in response to the relative illuminations of internal photosensors. A diffuser and light filter configuration is interposed between the controlled light and the photosensors to provide color selectivity.

1 Claim, 3 Drawing Sheets

LIGHT RESPONSIVE REMOTE CONTROL VEHICLE

FIELD OF THE INVENTION

This invention relates generally to remote control toy vehicles and particularly to those responsive to light energy sources.

BACKGROUND OF THE INVENTION

Through the years a number of amusement devices have been created which include one or more self-propelled miniature vehicles together with control systems for remotely operating the vehicles. A wide variety of control systems have been utilized for vehicle control and have included systems utilizing electrical controllers coupled to electrodes fabricated within the system track, radio frequency transmitting and receiving systems, infrared transmitting and receiving systems, and visible light communicating systems.

Of the various systems implemented, visible light control systems have several advantages in that the visible light energy is easy and inexpensive to produce and is easy for operators to accurately direct toward the to-be-controlled vehicles. In addition, since visible light includes a plurality of distinct colors, the use of visible light control systems permits the implementation of multiple control functions which are color selective.

These advantages have led practitioners in the art to develop several light responsive systems. One such system is set forth in U.S. Pat. No. 4,201,012 issued to Marshall for a REMOTE CONTROL VEHICLE in which a vehicle supports four light dependent resistors on its upper surface and includes a drive motor for driving the vehicle in forward or reverse direction and a steering motor for turning the vehicle in either left or right directions. The motors are coupled to the light dependent resistors such that illumination of a selected light dependent resistor produces a unique operation of either the steering or drive motors. Each of the light dependent resistors may be coupled to a light color sensitive filter to provide color selective response.

U.S. Pat. No. 4,086,724 issued to McCaslin sets forth a MOTORIZED TOY VEHICLE HAVING IMPROVED CONTROL MEANS in which a toy vehicle is propelled by a drive motor and is directed by a steering motor. A control system operates to permit the vehicle to change direction, move forwardly or to stop, in response to an external command such as sound energy or light energy. The control system is operative to steer the vehicle in response to the duration of applied control energy.

U.S. Pat. No. 3,406,481 issued to Tachi sets forth a MOVING TOY DIRECTION-VARIABLE BY A MODULATING RAY in which a toy vehicle is propelled in either direction by a pair of driven motors which are controlled by a rotatable tower member. The tower member supports a pair of photoconductive cells which operate each of the motors individually in response to light received by the cell. The operation of the vehicle is controlled such that the vehicle seeks equal illumination of the two photoconductive cells and is configured to cause the vehicle to seek to follow the source of modulating light incident upon the cells.

U.S. Pat. No. 3,314,189 issued to Carroll sets forth a REMOTE LIGHT ACTUATED CONTROL MEANS FOR MODELS in which a toy vehicle is operated by a drive motor and a steering motor. Light sources of different wavelengths are provided to permit the simultaneous operation of multiple toy vehicles about the track. A plurality of power conductors are supported upon the track surface and provide electrical energy to power the toy vehicles through a plurality of downwardly extending brush contacts on each of the toy vehicles.

U.S. Pat. No. 3,849,931 issued to Gulley, Jr. sets forth a DIRECTION SEEKING TOY VEHICLE in which a battery power toy vehicle includes drive means rotatably secured to the vehicle body to provide turning and maneuvering of the vehicle. A pair of light cells are supported on the forward portion of the vehicle and are isolated from each other by an intervening rib surface. The light cells on each side of the vehicle individually operate the drive motors on the associated side of the vehicle. As a result, the vehicle tends to follow a light source directed at the front portion of the vehicle.

British Pat. No. 848,454 issued to Nothelfer sets forth a REMOTE CONTROL SYSTEM FOR TOYS which operates in response to sound energy or light energy.

British Pat. No. 2,055,594 issued to Masudaya sets forth a SELF-POWERED TOY VEHICLE which responds to either sound or light energy control signals.

U.S. Pat. No. 3,308,577 issued to Holt sets forth a MINIATURE SAILING GAME CONTROLLED BY PHOTOCELLS in which a miniature sailboat includes a motor operated rudder coupled to a pair of light responsive photocells. The photocells are positioned on either side of the vessel and are operative to control the rudder movement in response to illumination of either of the photocells thereby achieving vessel steering.

In addition to the foregoing, various other amusement devices and toys have been provided. For example, U.S. Pat. No. 4,310,987 sets forth a rolling amusement device powered by light falling upon solar cells within the device. In addition, U.S. Pat. Nos. 4,702,718 and 4,662,854 set forth self-propelled toy devices which are responsive to light energy.

While the foregoing described prior art devices have enjoyed some limited success, they have generally been found to be impractical for commercial manufacture due to several limitations relating to receiver sensitivity and response to ambient light. It has been found that interference of ambient light in light responsive vehicles is particularly troublesome due to the wide range of ambient light conditions under which such vehicles are required to operate. Generally speaking, the ambient light conditions in typical toy vehicle use may vary from dark or semi-dark to bright sunlight and various artificial light conditions in between. As a result, there arises a need in the art for a light responsive remote control vehicle which successfully operates over a wide range of ambient light conditions and which is sufficiently inexpensive, small and efficient to be used in miniaturized toy vehicles.

SUMMARY OF THE INVENTION

Accordingly, it is a general object of the present invention to provide an improved light responsive remote control vehicle. It is a more particular object of the present invention to provide an improved light responsive remote control vehicle which successfully operates in a wide variety of ambient light circumstances. It is a still more particular object of the present invention to provide an improved light responsive remote control vehicle having minimum sensitivity to ambient light which is small in size and inexpensive to manufacture.

In accordance with the invention, there is provided a remote control vehicle for use in response to a controlling beam of colored light comprising: a vehicle having a body portion, a plurality of wheels, and a motor for propelling the vehicle; a motor control operatively coupled to the motor for selectively energizing the motor; circuit means coupled to the motor control including an pair of serially coupled photosensors defining a common junction therebetween producing a control signal in response to illumination of the photosensors by the colored light; and light coupling means, interposed between the photosensors and the colored light and supported by the vehicle, having a common diffuser and individual filters having different colors coupling the light illuminating the coupling means to the photosensors as distinct colored light.

BRIEF DESCRIPTIONS OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
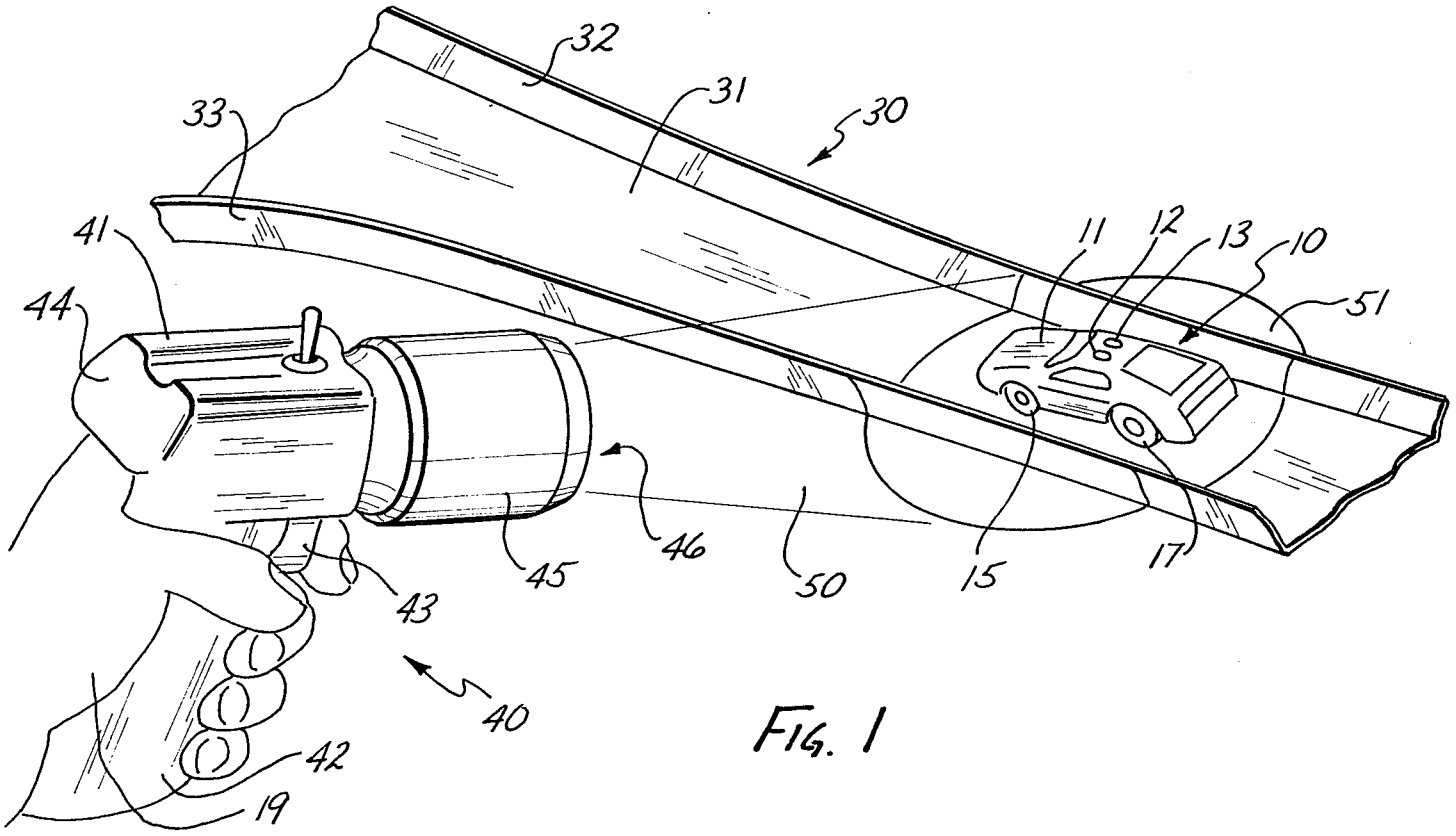
FIG. 1 is a perspective view of a light responsive remote control vehicle and controller constructed in accordance with the present invention.

FIG. 1 sets forth a perspective view of the present invention light responsive remote control vehicle generally referenced by numeral 10 in operation. Vehicle 10 includes a vehicle body 11 which may be fabricated in accordance with conventional fabrication techniques and which supports a conventional set of vehicle wheels 15, 16, 17 and 18. Wheels 16 and 18, while not visible in FIG. 1, should be understood to be the corresponding front and rear wheels respectively to wheels 15 and 17. Vehicle 10 should be further understood to include conventional battery powered propulsion apparatus by which vehicle 10 may be driven forward. In accordance with the invention, a pair of light sensors 12 and 13 extend upwardly through body 11. In addition, vehicle 10 further supports an electronic circuit responsive to light sensors 12 and 13 (not shown), embodiments of which are set forth below in greater detail in FIGS. 2 through 6 inclusive. A vehicle track 30, preferably formed of a molded plastic material, defines a generally flat road surface 31 and a pair of upwardly extending side walls 32 and 33. In accordance with conventional vehicle track systems, track 30 may be fabricated from a plurality of track segments joined by appropriate track joints to form a continuous track course over which vehicle 10 may be operated in the manner described below. A hand control unit 40 includes a housing 41 preferably formed of a molded plastic material having a horizontal upper portion 44 and a downwardly extending handle 42. Handle 42 further supports a movable trigger 43 while upper portion 44 of housing 41 further supports a forwardly extending generally cylindrical output section 45. Handle 42 is adapted to be readily held by an operator's hand 19 in the manner shown in FIG. 1 such that trigger 43 may be manipulated in a pistol grip-like grasp and in accordance with the descriptions set forth below. In further accordance with the descriptions set forth below in greater detail, control unit 40 includes a light source 46 (better seen in FIG. 2). By means set forth below in greater detail, control unit 40 is configured to produce a outwardly directed light beam 50 in response to operation of trigger 43. Light beam 50 is shaped to provide an illuminated area 51 which generally overlies much or all of vehicle 10 but which in particular is configured to assure easy illumination of light sensors 12 and 13.

In operation, control unit 40 is pointed or directed at vehicle 10 in the manner set forth in FIG. 1 and trigger 43 is depressed to produce light beam 50 and illuminated light sensors 12 and 13 of vehicle 10. By means set forth below in greater detail, the illumination of light sensors 12 and 13 by beam 50 causes vehicle 10 to be propelled forwardly upon track 30. As vehicle 10 is moved across track 30, controller 40 is moved to maintain the illumination of light sensors 12 and 13 and thereby continue the forward motion of vehicle 10. In the event light beam 50 is interrupted such as by a release of trigger 43 or is misdirected such that light sensors 12 and 13 are no longer illuminated, the forward propulsion of vehicle 10 is interrupted and vehicle 10 begins coasting and with continued absence of illumination of light sensors 12 and 13 will eventually stop. During the forward motion of vehicle 10, side walls 32 and 33 restrict the path of vehicle 10 to remain within road surface 31 of track 30.

In accordance with an important aspect of the present invention set forth below in greater detail, light source 46 includes a colored light filter which causes light beam 50 to be substantially dominated by a predetermined range of light wavelengths or colors. As a result and in accordance with the system set forth below in greater detail, light sensors 12 and 13, as well as the remainder of the present invention light responsive system, respond solely to the colored light provided in light beam 50 and are unresponsive to ambient light illuminating the area in which track 30 is situated. Thus, the operator may continuously operate vehicle 10 about track 30 by simply directing light beam 50 upon sensors 12 and 13 and manipulating trigger 43 to control the periods of illumination thereof to provide the desired periods of acceleration coasting and periodic stops.

Figure 2:
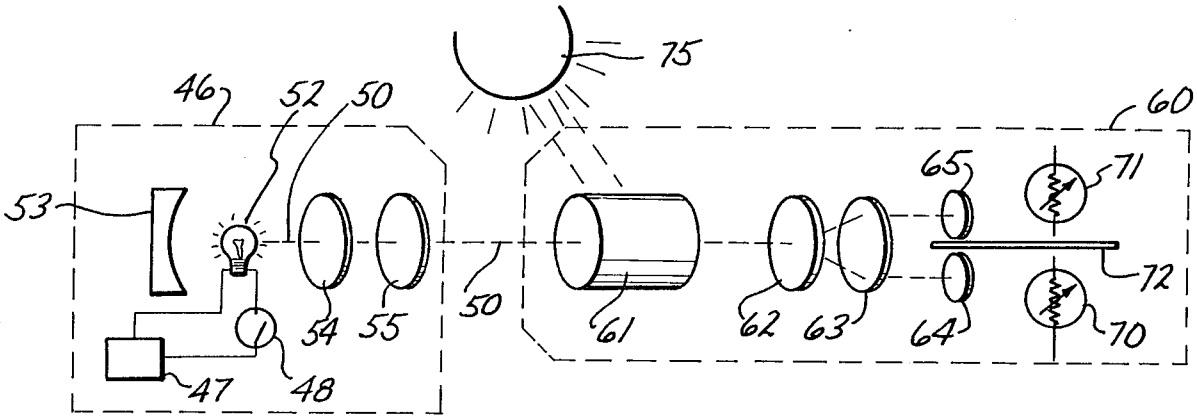
FIG. 2 is a pictorial representation of the light responsive control system of the present invention light responsive remote control vehicle.

FIG. 2 sets forth a pictorial representation of the control mechanism of the present invention light responsive remote control vehicle. Light source 46 includes a lamp 52 coupled to battery 47 and an interposed switch 48 configured to form a complete circuit by which operation of switch 48 controls the energizing of lamp 52. It will be apparent from examination of FIG. 1 and the descriptions above that switch 48 in the embodiment shown is manipulated by trigger 43. A reflector 53 is positioned with respect to lamp 52 to gather and direct a substantial portion of the light energy produced by lamp 52 when energized directing a light beam 50 to the right in FIG. 2. A colored filter 54 is positioned within the path of light beam 50 and the passage of light beam 50 therethrough causes light beam 50 to assume the corresponding color of filter 54. A lens 55 is supported within the path of light beam 50 to configure and partially focus light beam 50 to provide the desired illumination pattern (see illuminated area 51 in FIG. 1). Light beam 50 is directed to and received by a light receiver 60 constructed in accordance with the present invention. A light shade 61 is positioned within the path of beam 50 and is operative to partially shield light receiver 60 from ambient light produced from ambient light source 75 while transmitting light beam 50 to the remainder of light receiver 60. It will be apparent to those skilled in the art that, while a cylindrical shape is shown for light shade 61 in FIG. 2, different mechanical arrangements of light receiver 60 with respect to ambient light 75 will require differing configurations of light shade 61. The common factor to such configurations will remain, however, the ready transmission of colored light beam 50 and the partial or complete obstruction of ambient light 75. A pair of diffuser lenses 62 and 63 are positioned in the path of light beam 50 downstream of light shade 61 and are operative to disperse light beam 50 into a more uniform illumination pattern. A pair of colored filters 64 and 65, preferably having complimentary colors, are positioned downstream of diffusion lenses 62 and 63. An opaque separation 72 is interposed between colored filters 64 and 65 to isolate the light passing through each of the filters and prohibit interaction therebetween. A pair of photosensors 70 and 71 are positioned downstream of colored filters 64 and 65 respectively and on opposite sides of separator 72. In accordance with the invention, the light passing through filters 64 and 65 is directed to and illuminates photosensors 70 and 71 respectively to provide the detection of the control beam produced by control unit 40 (seen in FIG. 1).

In operation, therefore, the light produced by lamp 52 is directed by reflector 53 through colored filter 54 and lens 55 to form a colored light beam 50 which passes through light shade 61, diffusion lenses 63, and filters 64 and 65 to illuminated photosensors 70 and 71. By means set forth below in greater detail, the illumination of sensors 70 and 71 produces a control signal which is utilized to cause vehicle 10 to respond to beam 50.

As mentioned above in connection with FIG. 1, it is desirable that vehicle 10 responds solely to light beam 50 and be insensitive to the ambient light present in the area of operation of vehicle 10. As is known, the character of ambient light which may be anticipated in the typical environments in which a remote control vehicle of the type shown in operated, may vary substantially from dark or semi-dark environments to brightly illuminated artificially lighted areas or areas subjected to direct sunlight. It is this ambient light circumstance which has degraded the performance of many of the prior art systems described above. While the intended function of light shade 61 is to greatly reduce the amount of ambient light which eventually reaches photosensors 70 and 71, substantial amounts of ambient light may nonetheless pass through light shade 61 and the remainder of light receiver 60 to illuminated photosensors 70 and 71. Accordingly and in accordance with an important aspect of the present invention, it is desirable therefore that the effect of ambient light illumination of photosensors 70 and 71 be clearly distinguishable from the effect of illumination thereof by colored light beam 50. Accordingly, the transmission characteristics of filters 64 and 65 are selected to provide approximately equal light transmission to photosensors 70 and 71 respectively under illumination of noncolored ambient light. In addition as is set forth in greater detail, the operation and response of the electronic circuits of the present invention system are configured to further ensure the system's ability to be nonresponsive to ambient light.

Figure 3:
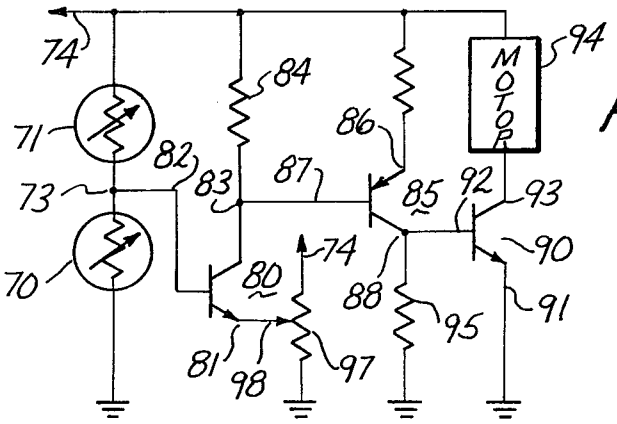
FIG. 3 is a circuit diagram of the electronic portion of the present invention light responsive remote control vehicle.

FIG. 3 sets forth a circuit diagram of the electronic control portion of the present invention light responsive remote control system. Photosensors 70 and 71 are serially coupled between ground and a source of operating potential 74 to define a junction therebetween 73. An NPN transistor 80 includes an emitter electrode 81, a base electrode 82 coupled to junction 73, and a collector electrode 83 coupled to operating supply 74 by a resistor 84. A balance adjust potentiometer 97 is coupled between operating potential 74 and ground and includes a movable contact 98 coupled to emitter 81. A PNP transistor 85 includes an emitter electrode 86 coupled to supply 74 by a resistor 96, a base electrode 87 coupled to collector 83, and a collector electrode 88 coupled to ground by a resistor 95. An NPN transistor 90 includes an emitter electrode 91 coupled to ground, a base electrode 92 coupled to collector 88, and a collector electrode 93. A motor 94 which comprises the drive motor of vehicle 10 is coupled between collector 93 and supply 74.

In operation and in response to ambient light in the absence of colored light illumination, photosensors 70 and 71 which, in the embodiment shown comprise light dependent resistors, provide a resistance related to the amount of light energy received by sensors 70 and 71. As mentioned above in connection with FIG. 2, filters 64 and 65 are configured to provide approximately equal light energy transmissions in response to ambient light. As a result, sensors 70 and 71 provide approximately equal resistances in response to ambient light and the voltage at junction 73 is approximately one-half of supply voltage 74. The positive voltage at junction 73 is applied to base 72 of NPN transistor 80. In accordance with the invention, the potential at emitter 81 of transistor 80 is adjusted by movement of movable contact 98 to provide a voltage at emitter 81 approximately equal to that at base 82 under ambient light conditions. Thus, with emitter and base voltages approximately equal, transistor 80 remains nonconductive and the voltage at collector 83 is approximately equal to the voltage of supply 74. With a positive voltage at collector 83 being applied to base 87 of PNP transistor 85, transistor 85 is similarly nonconducting and the voltage at collector 88 thereof is approximately equal to ground potential. Since emitter 91 of NPN transistor 90 is also at ground potential, no forward bias is applied to transistor 90 and transistor 90 in nonconducting. In the absence of conduction by transistor 90, no current flows through motor 94 and no forward propulsion of vehicle 10 results. It should be noted that in accordance with an important aspect of the present invention, the circuitry shown in FIG. 3 substantially ignore changes in the overall intensity of ambient light applied due to the tendency of sensors 70 and 71 to change equally in response to changes in ambient light intensity. The equal changes in ambient light intensity maintain the voltage at junction 73 and base 82 of transistor 80 substantially constant. As a result, notwithstanding intensity changes of ambient light, transistor 80 remains nonconductive so long as the voltage at base 82 remains below the forward bias voltage required with respect to emitter 81 to turn transistor 80 on. Because the voltage required to forward bias the emitter base junction of transistor 80 is significant (approximately 0.5 volts), some imbalance of the responses of sensors 70 and 71 may be tolerated by the circuit of FIG. 3 without erroneously energizing motor 94 in response to ambient light.

The response of the circuit of FIG. 3 to illumination by a colored light beam is best understood with temporary reference to FIG. 2 in combination with FIG. 3. Accordingly, with colored light beam 50 incident upon diffuser lenses 63 and 64, the light energy passing through filters 64 and 65 results in substantially different transmission effects due to the color selectivity of filters 64 and 65. As mentioned, filters 64 and 65 are preferably complimentary filters. However, any number of colored filter combinations may be utilized with the essential element being a substantially different response to the color imposed upon light beam 50 by colored filter 54 within light source 46. As a result, the amount of light energy falling upon sensors 70 and 71 in response to colored light illumination is substantially different and results in the establishment of substantially different resistive characteristics in sensors 70 and 71. In accordance with the operation of the circuit of FIG. 3, the colors of filters 64 and 65 are selected with respect to the color of beam 50 such that the resistance of sensor 71 decreases substantially more than the resistance of sensor 70. With a substantial decrease in resistance of sensor 71, the voltage at junction 73 becomes substantially more positive. As a result, this positive voltage applied to base 82 of transistor 80 provides sufficient forward bias of the emitter base junction of transistor 80 to cause transistor 80 to conduct. With the conduction of transistor 80, the voltage at collector 83 and base 87 is reduced which in turn provides a forward bias voltage for the emitter base junction of transistor 85 causing it to conduct. The conduction of transistor 85 establishes a positive voltage at collector 88 which in turn provides a forward bias voltage for the emitter base junction of transistor 90 causing transistor 90 to conduct. The conduction of transistor 90 causes a flow of current through motor 94 energizing it and propelling vehicle 10 along track 30 (seen in FIG. 1). The energizing of motor 94 continues so long as the illuminating light of beam 50 causes the imbalance in the resistances of sensors 70 and 71. Once the illumination of beam 50 terminates or is interrupted, the resistances of sensors 70 and 71 return to approximately equal resistances and transistors 80, 85 and 90 return to nonconducting states and motor 94 is no longer energized.

It will be apparent to those skilled in the art that once the initial adjustment of potentiometer 97 is made, the circuit of 53 will be generally insensitive to substantial ambient light conditions and provide the desired operation of vehicle 10 solely in response to colored light illumination.

Figure 4:
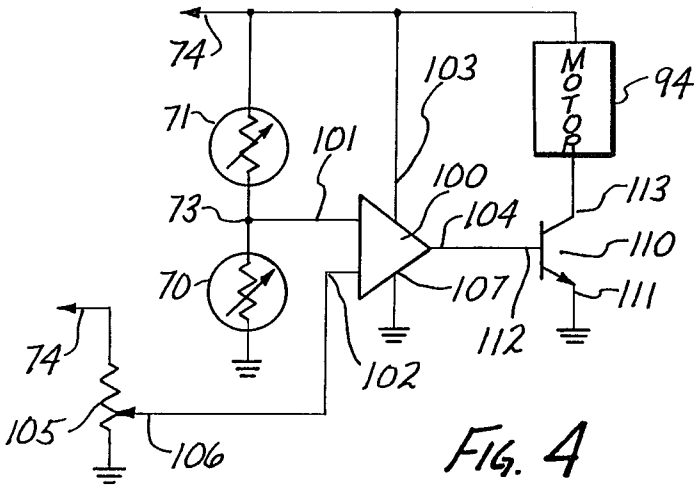
FIG. 4 is a circuit diagram of an alternate embodiment of the electronic portion of the present invention light responsive remote control vehicle.

FIG. 4 sets forth an alternate electronic circuit for use in the present invention system. A comparator 100 constructed in accordance with conventional comparator devices includes a supply terminal 103 coupled to supply 74, an input terminal 101, a reference input terminal 102, a ground terminal 107, and an output terminal 104. A pair of light sensors 70 and 71, each comprising light dependent resistors, are serially coupled between ground and supply 74 forming a junction 73 therebetween. Junction 73 is coupled to input terminal 101 of comparator 100. A balance adjustment potentiometer 105 is coupled between supply 74 and ground and includes a movable contact 106 coupled to reference input terminal 102 of comparator 100. An NPN transistor 110 includes an emitter electrode 111 coupled to ground, a base electrode 112 coupled to output terminal 104, and a collector electrode 113. A motor 94 which comprises a conventional propulsion motor for vehicle 10 (seen in FIG. 1) is coupled between collector 113 and supply 74.

At the outset, it should be noted that the serial combination of sensors 70 and 71 are substantially the same in operation as that set forth for sensors 70 and 71 in FIG. 3. In addition, it should also be noted that motor 94 operates in accordance with conventional fabrication techniques and responds in the similar manner to motor 94 set forth in FIG. 3. Accordingly, in the presence of ambient light and in the absence of colored light beam 50, the resistances of sensors 70 and 71 are approximately equal providing a voltage at junction 73 of approximately one-half the voltage of supply 74 which is coupled to input 101 of comparator 100. Correspondingly, the voltage applied to reference input 102 of comparator 100 is adjusted by movement of movable contact 106 of balance adjustment 105. In accordance with conventional comparator function, comparator 100 produces an output signal at terminal 104 whenever the input signal at terminal 101 exceeds the reference signal at terminal 102 by a predetermined threshold or amount. Accordingly, with ambient light as the sole illumination of sensors 70 and 71, balance adjustment 105 is adjusted to provide a reference voltage at terminal 102 which precludes operation of comparator 100 until the voltage at input 101 is increased further by an additional amount. Accordingly, in the absence of colored light beam 50 illuminating sensors 70 and 71, the voltage at junction 73 and terminal 101 is insufficient to cause comparator 100 to produce an output signal at terminal 104. In the absence of an output signal at terminal 104 and base 112, the emitter base junction of transistor 110 is not forward biased and transistor 110 is nonconducting. As a result, no current is carried through motor 94 and vehicle 10 is not powered. As described above, the combination of sensors 70 and 71 and filters 64 and 65 are selected to provide substantially equal resistance changes in sensors 70 and 71 as a result of changes in the intensity of ambient light received. Therefore, with equal resistance changes in sensors 70 and 71, the voltage at input 101 of comparator 100 remains substantially constant. It should be noted that small nonlinearities and imbalances in the system may be accommodated by the threshold difference required by comparator 100 between the voltages at terminals 101 and 102 for operation. In addition, further imbalances in the system may be accommodated by a compensating adjustment of balance adjustment control 105. In either event, once the circuit of FIG. 4 is properly adjusted, substantial variations of the intensity of ambient light received by sensors 70 and 71 will not upset the operation of the present invention system.

In the presence of illumination of vehicle 10 by colored light beam 50, the above-described changes in resistance of sensors 70 and 71 occurs due to the color selectivity of filters 64 and 65. As a result, the voltage at junction 73 and input terminal 101 of comparator 100 increases causing a sufficient voltage difference between the voltages at inputs 101 and 102 to cause comparator 100 to produce an output voltage at terminal 104. The output voltage at terminal 104 comprises a positive voltage which is applied to base 112 forward biasing the emitter base junction of transistor 110 causing it to conduct. The conduction of transistor 110 produces a current flow through motor 94 which in turn propels vehicle 10 in the desired manner. The propulsion of vehicle 10 continues until interruption occurs in the illumination of colored light beam 50 upon sensors 70 and 71. With interruption of colored light, the resistances of sensors 70 and 71 again return to approximately equal values returning the voltage at input terminal 101 to its ambient light voltage causing comparator 100 to cease producing an output signal at terminal 104. In the absence of forward biasing of the emitter base junction of transistor 110, the conduction through motor 94 ceases and vehicle 10 is no longer powered.

Figure 5:
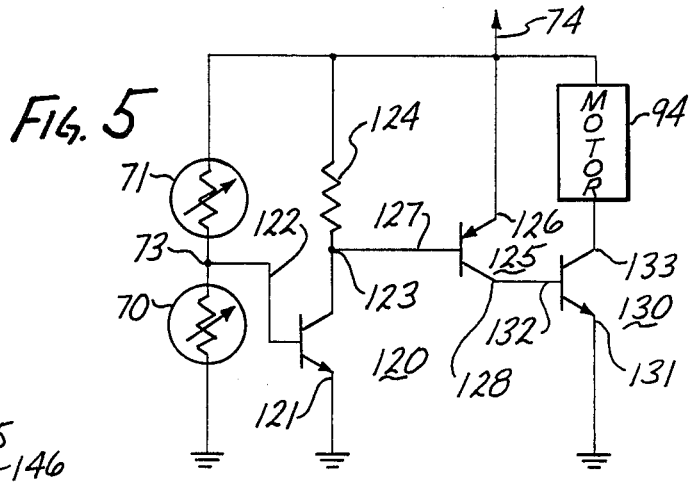
FIG. 5 is a circuit diagram of a further alternate embodiment of the electronic portion of the present invention light responsive remote control vehicle.

FIG. 5 sets forth a simplified electronic circuit for operation in the present invention light responsive remote control vehicle. A resistor 119 and sensors 70 and 71 are serially coupled between supply 74 and ground. The connection of sensors 70 and 71 forms a junction 73. An NPN transistor 120 includes an emitter electrode 121 coupled to ground, a base electrode 122 coupled to junction 73, and a collector electrode 123 coupled to supply 74 by a resistor 124. A PNP transistor 125 includes an emitter electrode 126 coupled to supply 74, a base electrode 127 coupled to collector 123, and a collector electrode 128. An NPN transistor 130 includes an emitter electrode 131 coupled to ground, a base electrode 132 coupled to collector 128, and a collector electrode 133. A motor 94 is coupled between supply 74 and collector 133.

The circuit of FIG. 5 conforms generally to the circuit of FIG. 3 with the primary exception being the illumination of balance adjustment control 94 and the addition of resistor 119 to the serial combination of sensors 70 and 71. In the presence of ambient light and in the absence of colored light beam 50, the resistances of sensors 70 and 71 are substantially equal and a voltage is produced at junction 73 which results from the voltage division of the proportionate part of the total resistance provided by sensor 70. In accordance with the system criteria for not responding to ambient light, resistor 119 is selected such that with equal resistances of sensors 70 and 71 the voltage at junction 73 and therefore base 122 is insufficient to forward bias the emitter base junction of transistor 120. As a result, transistor 120 does not conduct in the sole presence of ambient light and a positive voltage is present at collector 123 and base 127 which is substantially equal to the voltage of supply 74. As a result, the emitter base junction of transistor 125 is not forward biased and transistor 125 remains nonconducting. In the absence of conduction by transistor 125, transistor 130 remains similarly nonconducting and no motor current passes through motor 94. Because the forward bias voltage required to produce conduction of transistor 120 is approximately one-half volt, some variation of the voltage at junction 73 may be tolerated by the circuit of FIG. 5 due to intensity variations of ambient light without producing undesired energizing of motor 94. Essentially, the system of FIG. 5 utilizes the forward bias increment required for transistor 120 to establish a tolerance range of the circuit's response to ambient light.

Upon illumination of sensors 70 and 71 by colored light beam 50, a substantial decrease in the relative resistance of sensor 71 with respect to sensor 70 causes an increase in the voltage at junction 73 and base 122 sufficient to forward bias the emitter base junction of transistor 120 and cause it to conduct. The conduction of transistor 120 lowers the voltage at base 127 causing transistor 125 to conduct and provide a base current and forward bias voltage for transistor 130. Transistor 130 thereafter conducts providing a motor current through motor 94 which propels vehicle 10 in the forward direction. The operation of motor 94 continues until the illumination by colored light beam 50 is interrupted. With the interruption of colored light illumination, the resistances of sensors 70 and 71 return to approximately equal resistances and transistor 120 is no longer forward biased and ceases conducting. The nonconduction of transistor 120, in turn, turns off transistors 125 and 130 interrupting the current through motor 94 causing vehicle 10 to begin coasting and eventually stop.

Figure 6:
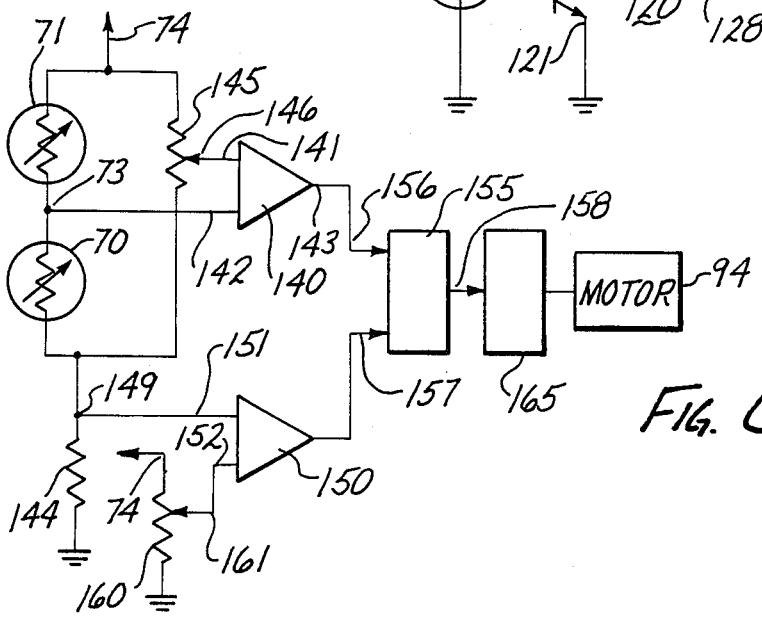
FIG. 6 is a circuit diagram of a still further alternate embodiment of the electronic portion of the present invention light responsive remote control vehicle.

FIG. 6 sets forth an electronic circuit in accordance with the present invention which provides for a greater tolerance of an increased range of ambient light intensities. Photosensors 70 and 71 which again comprise light dependent resistors are serially connected forming a junction 73 therebetween. In addition, sensor 71 is coupled to supply 74 while sensor 70 is coupled to ground by a resistor 144. The connection of sensor 70 and resistor 144 forms a junction 149. A color balance control 145 is coupled between supply 74 and junction 149 and includes a movable contact 146. A comparator 140 includes an input terminal 141 coupled to movable contact 146, an input terminal 142 coupled to junction 73, and an output terminal 143. A comparator 150 includes an input terminal 151 coupled to junction 149, an input terminal 152, and an output terminal 153. A light intensity adjustment 160 is coupled between supply 74 and ground and includes a movable contact 161 coupled to input terminal 152. A logic network 155 includes an input terminal 156 coupled to terminal 143, an input terminal 157 coupled to terminal 153, and an output terminal 158. A motor driver 165 is coupled to terminal 158 of logic circuit 155. Motor driver 165 should be understood to include appropriate drive circuitry for coupling to and operating motor 94.

The operation of the circuit of FIG. 6 is best understood if initially it is pointed out that the combination of sensors 70 and 71 and color balance adjustment control 145 form a bridge circuit having balance points corresponding to junction 73 and movable contact 146. Thus, the voltage difference between junction 73 and movable contact 146 results from a balance change occurring in the bridge circuit thus formed. It should also be noted that the current from either branch of the above-described bridge circuit, whether flowing through the serial combination of sensors 70 and 71 or flowing through adjustment 145, are conducted to ground by a common resistor 144. As a result, the voltage at junction 149 is representative of the total current passing through the bridge combination. In addition, it should be recalled that filters 64 and 65 (seen in FIG. 2) and sensors 70 and 71 are selected to provide equal resistance changes in the presence of ambient light and in the absence of colored light illumination. It should be further recalled that in response to colored light illumination the relative resistances of sensors 70 and 71 is altered which in turn changes the voltage at junction 73.

As a result, the combination of sensors 70 and 71, control 145, and resistor 144 produce a differential voltage between junction 73 and contact 146 which indicates a colored light illumination and a voltage at junction 149 which is directly proportional to the total illumination of light receiver 60 from both ambient and color sources.

Accordingly, color balance adjustment 145 is initially adjusted such that comparator 140 produces an output signal when the differential voltage between contact 146 and junction 73 exceeds a predetermined magnitude. As a result, comparator 140 responds to the occurrence of colored light illumination of sensors 70 and 71. Control 160 is adjusted to provide operation of comparator 150 whenever the voltage at junction 149 exceeds a predetermined level. As a result, comparator 150 produces an output signal whenever the total illumination of sensors 70 and 71, whether ambient light, colored light or both, exceeds a predetermined intensity.

As a result, the signal is applied to input terminal 156 of logic 155 indicative of a color illumination while a second signal is applied to input 157 which indicates a high intensity illumination condition. Logic circuitry 155 responds to the input signals at terminals 156 and 157 to produce an output signal at terminal 158 which is solely indicative of colored light illumination. As a result, logic circuit 155 utilizes the intensity related signal at input 157 to distinguish between input signals at terminal 156 which result solely from imbalances caused by extremely high intensity ambient conditions. But for the use of the intensity related signal by logic circuit 155, extremely high intensity ambient light would otherwise produce sufficient imbalance in the system to erroneously indicate the presence of colored light illumination. The output signal at terminal 158 indicative of colored light illumination is applied to driver circuit 165 which in accordance with conventional motor control fabrication techniques produces a corresponding energizing of motor 94 and forward motion of vehicle 10.

It should be understood that the foregoing described circuit embodiments in FIGS. 3 through 6 have used and are configured for light dependent resistor devices for sensors 70 and 71. It will be apparent to those skilled in the art, however, that the present invention system may utilize other photosensing elements which may be incorporated in the circuit configurations shown in FIGS. 3 through 6 with corresponding circuit alterations without departing from the spirit and scope of the present invention.

Figure 7:
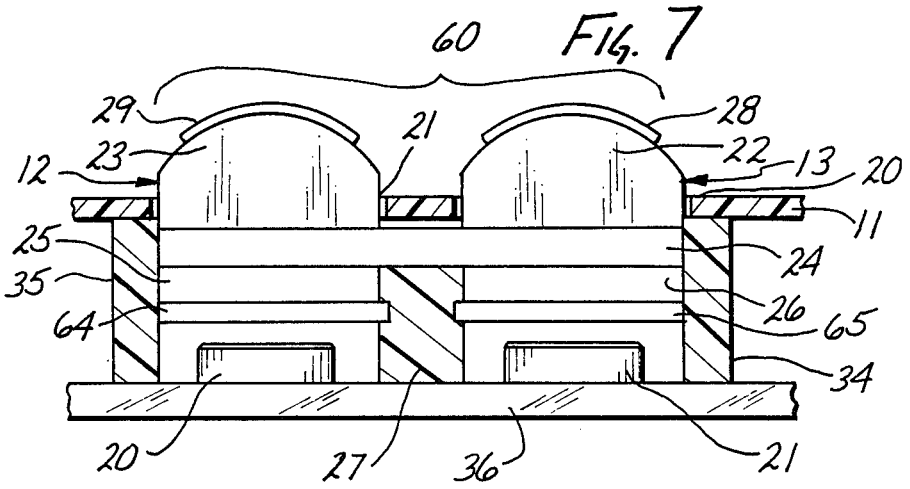
FIG. 7 is a partial section view of the light sensing apparatus of the present invention light responsive remote control vehicle.

FIG. 7 sets forth a partial section view of light receiver 60. Body 11 of vehicle 10 defines a pair of apertures 20 and 21, a pair of inwardly extending wall portions 34 and 35, and a separator 27. A printed circuit board 36 is constructed in accordance with conventional printed circuit board fabrication techniques and by means not shown supports a selected one of the circuits shown in FIGS. 3 through 6. A pair of light sensors 70 and 71 are supported upon printed circuit board 36 in accordance with conventional fabrication techniques and make appropriate electrical connections to the selected one of the electronic circuits shown in FIGS. 3 through 6 in the manner shown therein. Walls 34 and 35 and separator 27 form a pair of cavities 26 and 25 respectively surrounding light sensors 71 and 70 respectively. A pair of color filters 64 and 65 constructed in accordance with the above-described characteristics are supported within cavities 25 and 26 respectively and overlie light sensors 70 and 71 respectively. A diffuser 24 defines a generally planar structure extending between walls 34 and 35 and covering cavities 25 and 26. In addition, diffuser 24 includes a pair of generally spherical upwardly extending lens member 22 and 23 extending through apertures 20 and 21 respectively. Lenses 22 and 23 in turn support shade members 28 and 29 respectively. In accordance with the invention, diffuser 24 including lenses 22 and 23 may be formed from a single molded plastic unit having either a transparent or translucent light characteristic. Shades 28 and 29 may, in their simplest form, comprise layers of opaque material coated upon the outer surfaces of lenses 22 and 23 respectively. Alternatively, shades 28 and 29 may comprise opaque members secured to or supported above lenses 22 and 23.

In accordance with the above-described operation, light illuminating body 11 is incident upon lenses 22 and 23 and by operation of diffuser 24 generally coupled to cavities 25 and 26 as diffuse light energy. The light energy from diffuser 24 passes through cavities 25 and 26 and through filters 64 and 65 respectively to illuminate light sensors 70 and 71 respectively. Shades 28 and 29 are positioned upon the outer surfaces of lenses 22 and 23 respectively in anticipation of operation of vehicle 10 in an environment in which a high intensity ambient light illuminates vehicle 10 from more or less directly above. Accordingly, the presence of shades 28 and 29 establishes a greater responsiveness for light receiver 60 to light sources illuminating receiver 60 from angles substantially less than directly overhead. Accordingly, it will be understood by those skilled in the art that shades 28 and 29 may, in accordance with the anticipated environment in which vehicle 10 is operating, be either completely opaque, partially opaque, or form graded or graduated shading elements having minimum transmissive character at their centers.

What has been shown is a light responsive remote control vehicle which operates over a wide range of ambient light conditions and which utilizes a relatively inexpensive structure and which may be manufactured in extremely small and compact configurations to facilitate its use within miniaturized remote control vehicles.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A remote control vehicle for use in response to a controlling beam of colored light comprising:

a vehicle having a body portion, a plurality of wheels, and a motor for propelling said vehicle;

a motor control operatively coupled to said motor for selectively energizing said motor;

circuit means coupled to said motor control including an pair of serially coupled photosensors defining a common junction therebetween producing a control signal in response to illumination of said photosensors by said colored light; and light coupling means, interposed between said photosensors and said colored light and supported by said vehicle, having a common diffuser and individual filters having different colors coupling the light illuminating said coupling means to said photosensors as distinct colored light.

* * * * *